US009887483B2

(12) United States Patent
Zhang et al.

(10) Patent No.: US 9,887,483 B2
(45) Date of Patent: Feb. 6, 2018

(54) SOCKET

(71) Applicant: Schneider Electric (Australia) Pty Ltd, Macquarie Park (AU)

(72) Inventors: Dahai Zhang, Shenzhen (CN); Pei Shang, Shenzhen (CN)

(73) Assignee: Schneider Electric (Australia) Pty Ltd., NSW (AU)

( * ) Notice: Subject to any disclaimer, the term of this patent is extended or adjusted under 35 U.S.C. 154(b) by 0 days.

(21) Appl. No.: 15/259,277

(22) Filed: Sep. 8, 2016

(65) Prior Publication Data

US 2017/0085022 A1 Mar. 23, 2017

(30) Foreign Application Priority Data

Sep. 17, 2015 (CN) ..... 2015 1 0596083

(51) Int. Cl.
*H01R 13/44* (2006.01)
*H01R 13/453* (2006.01)
*H01R 24/76* (2011.01)

(52) U.S. Cl.
CPC ..... *H01R 13/4534* (2013.01); *H01R 24/76* (2013.01)

(58) Field of Classification Search
CPC ..... H01R 13/453
USPC ..... 439/138, 137, 143
See application file for complete search history.

(56) References Cited

U.S. PATENT DOCUMENTS 5,277,602 A * 1/1994 Yi ..... H01R 13/7036 439/138
6,932,631 B2 * 8/2005 Huang ..... H01R 13/4536 439/143
8,632,348 B2 * 1/2014 Baldwin ..... H01R 13/4534 439/138
2009/0239400 A1 * 9/2009 Ni ..... H01R 13/4534 439/138
2012/0083143 A1 * 4/2012 Jiang ..... H01R 13/4534 439/137
2013/0189864 A1 * 7/2013 Chen ..... H01R 13/453 439/136

(Continued)

*Primary Examiner* — Abdullah Riyami
*Assistant Examiner* — Nader Alhawamdeh
(74) *Attorney, Agent, or Firm* — Kilpatrick Townsend & Stockton LLP; Dean W. Russell

(57) ABSTRACT

Embodiments of the present invention relate to a socket, comprising: a seat body including two insertion holes allowing two pins of a plug to insert respectively; wherein, an individual protective door movable member is disposed for each of the insertion holes in the seat body, the protective door movable member is configured in a way that when no pin of a plug is inserted into the insertion holes, the protective door movable members close corresponding insertion holes, and when the pins of the plug are inserted into the insertion holes, the protective door movable members are driven to move along a defined trajectory to open the corresponding insertion holes to allow the pins of the plug to extend into the insertion holes, and wherein movement of the protective door movable members along the defined trajectory makes the movement trajectory of at least a portion of the protective door movable members different from the movement trajectory of another portion of the protective door movable members. The socket according to the present invention has a flat and pleasant appearance and occupies little internal space of the socket.

11 Claims, 9 Drawing Sheets

(56) References Cited

U.S. PATENT DOCUMENTS

| | | | | |
|---|---|---|---|---|
| 2015/0288089 | A1* | 10/2015 | Underwood | H01R 13/4534<br>439/137 |
| 2015/0372410 | A1* | 12/2015 | Li | H01R 13/4532<br>439/138 |
| 2015/0372412 | A1* | 12/2015 | Samojeden | H01R 13/4536<br>439/138 |
| 2016/0013577 | A1* | 1/2016 | Diakomis | H01R 13/4536<br>439/138 |
| 2017/0085022 | A1* | 3/2017 | Zhang | H01R 13/453 |

* cited by examiner

SOCKET

FIELD OF THE INVENTION

Embodiments of the present invention relate to a socket, and particularly to a socket having a protective door for protecting insertion holes.

BACKGROUND OF THE INVENTION

A socket is a commonly-used electrical connection device. A plug of an electrical/electronic apparatus is inserted into insertion holes of the socket so that the electrical/electronic apparatus is electrically connected to a power supply or signal source/signal receiving terminal.

Insertion holes on an ordinary socket are exposed outside and have potential risks that a user might inadvertently extend a foreign matter into the exposed insertion holes without any obstruction causing accidents such as shock, short-circuiting or the like. Particularly, kids might, out of curiosity, extend his fingers into the exposed insertion holes and get confronted with an accident such as shock. Exposed insertion holes are also apt to accumulation of dusts or foreign matters, which causes blocking of the insertion holes or poor conductive contact.

At present, there is a kind of socket having a protective door. The protective door is disposed in the insertion holes of the socket. The protection door closes the insertion holes when the socket is not used, to avoid the above danger; when the plug is inserted into the insertion holes, the plug pushes an inclined surface of the protective door facing the plug, which inclined surface converts an insertion action of the plug perpendicular to the socket panel into a movement of the protective door in a direction parallel to the socket panel so that the protective door moves towards a lateral direction of the insertion holes to open the insertion holes, whereby the plug may be inserted deep into the insertion holes. However, such socket still has drawbacks. Since a side of a movable member of the protective door facing the plug is an inclined surface, the insertion holes still form inwardly-recessed depressions as viewed externally so that such socket appears not aesthetical enough. More importantly, dusts are apt to accumulate in the depressions (particularly a lot of dusts fall into the depressions during decoration) and it is very difficult to thoroughly clean the dusts, causing the depressions more unpleasant in appearance and the plug hardly pushing the protective door open to insert into the insertion holes.

Therefore, it is desirable to provide a socket which can not only avoid the above danger, but also has more pleasant appearance and reliable performance.

SUMMARY OF THE INVENTION

According to an aspect of the present invention, there is provided a socket, comprising: a seat body including two insertion holes allowing two pins of a plug to insert respectively. An individual protective door movable member is disposed for each of the insertion holes in the seat body. The protective door movable members are configured in a way that when no pin of the plug is inserted into the insertion holes, the protective door movable members close corresponding insertion holes, and when the pins of the plug are inserted into the insertion holes, the protective door movable members are driven to move along a defined trajectory to open the corresponding insertion holes to allow the pins of the plug to extend into the insertion holes. Movement of the protective door movable members along the defined trajectory makes the movement trajectory of at least a portion of the protective door movable members different from the movement trajectory of another portion of the protective door movable members.

According to another aspect of the present invention, the protective door moveable member has a first end and a second end, the first end is provided with a protective door cooperating with the insertion hole and a first protective door guide structure, the second end is provided with a second protective door guide structure, the first protective door guide structure and the second protective door guide structure are guided by a seat body guide structure on the seat body such that a movement component of the first protective door guide structure in an axial direction of the insertion hole is greater than a movement component of the second protective door guide structure in the axial direction of the insertion hole, while a movement component of the first protective door guide structure in a direction perpendicular to the axial direction of the insertion hole is smaller than a movement component of the second protective door guide structure in a direction perpendicular to the axial direction of the insertion hole.

According to a further aspect of the present invention, the first protective door guide structure and the second protective door guide structure are guided by the seat body guide structure on the seat body such that the first protective door guide structure moves in a linear manner or a curve manner in a direction inclined relative to the axial direction of the insertion hole, while the second protective door guide structure moves in a direction perpendicular to the axial direction of the insertion hole.

According to a further aspect of the present invention, a slot is provided between the first end and second end of the protective door movable member, and one of the protective door movable members runs through the slot in the other of the protective door movable members and is disposed crossed with the other of the protective door movable members such that when the pins of the plug extend into the insertion holes, the first ends of the two protective door movable members are driven towards each other, so that each pin of the plug runs through the slot in the other protective door movable member between the protective door of the protective door movable member corresponding to the insertion hole into which the pin is inserted and the second end of the other protective door movable member.

According to a further aspect of the present invention, one of the protective door movable members is disposed separate from the other such that when the pins of the plug are inserted into the insertion holes, the first ends of the two protective door movable members are driven away from each other so that each pin of the plug can pass by the protective door movable member outside the first end of the protective door movable member corresponding to the insertion hole into which the pin is inserted.

According to a further aspect of the present invention, the first protective door guide structure and the second protective door guide member are guide protrusions while the seat body guide structures are guide grooves slidably fitting with the guide protrusions, or the seat body guide structures are guide protrusions while the first protective door guide structure and the second protective door guide member are guide grooves slidably fitting with the guide protrusions.

According to another aspect of the present invention, the seat body guide structure are further configured to guide the first protective door guide structure to move only in the axial direction of the insertion hole when the pins of the plug just begin to extend into the insertion holes.

According to a further aspect of the present invention, a mounting slot is provided on the seat body, a guide surface is disposed in the mounting slot, an insertion block is inserted in the mounting slot, the insertion holes are located on the insertion block, a guide surface is disposed on the insertion block so that the guide surface on the insertion block cooperates with the guide surface in the mounting slot to form the guide groove slidably fitting with the first protective door guide structure and second protective door guide structure.

According to a further aspect of the present invention, a return spring is connected between the protective door movable members and the seat body to urge the protective door movable members to move in a reverse direction along the defined trajectory to close the corresponding insertion hole again after the pins of the plug retreat out of the insertion holes.

According to a further aspect of the present invention, locking protrusions are provided on the second ends of the protective door movable members. When only one of the two insertion holes is inserted with a pin of the plug, the locking protrusion on the protective door movable member corresponding to the insertion hole into which the pin is not yet inserted blocks movement of the protective door movable member corresponding to the insertion hole into which the pin is inserted, to block further insertion of the pin which is already inserted into the insertion hole.

According to a further aspect of the present invention, a side of the protective door facing outside of the insertion hole is a plane.

According to a further aspect of the present invention, a face cover is further provided on an outer surface of the seat body, face cover holes in alignment with the insertion holes are provided on the face cover at positions corresponding to the insertion holes, and in a state that the protective door movable members close the insertion holes, the plane of the protective door of the protective door movable member facing outside of the insertion holes is flush with the outer surface of the face cover.

With the socket according to the embodiment of the present invention being provided with protective door movable members which may make a composite movement including translation and rotation, the protective door movable members of the socket can convert the movement of the plug in the axial direction of the insertion holes into a movement of the protective door movable members for opening the insertion holes, and meanwhile, the protective doors on the protective door movable members have an outer surface flushing with the outer surface of the socket. This enables the socket according to the embodiment of the present invention to have flat and pleasant appearance and refrain from accumulation of dusts. A single protective door structure in each insertion hole further improves the pleasant appearance of the socket. The composite movement of the protective door movable member enables the protective door movable member to "lie down" in the socket, thereby occupying a very small space in the axial direction of the insertion hole during its movement, which facilitates the lighted and thinned design of the socket and avoids hindrance for electrical structures in the socket. The protective door movable members of the socket according to the embodiment of the present invention have a stable and reliable movement mechanism, and safety of the socket is further improved by preventing dual insertion holes being inserted with single pin of the plug.

BRIEF DESCRIPTION OF DRAWINGS

These and other objectives, features and advantages will be made obvious when the following detailed description of exemplary embodiments is read in conjunction with figures. Among the figures.

DETAILED DESCRIPTION OF PREFERRED EMBODIMENTS

Various embodiments of the present invention are hereby described in detail only in an exemplary manner.

Figure 1:
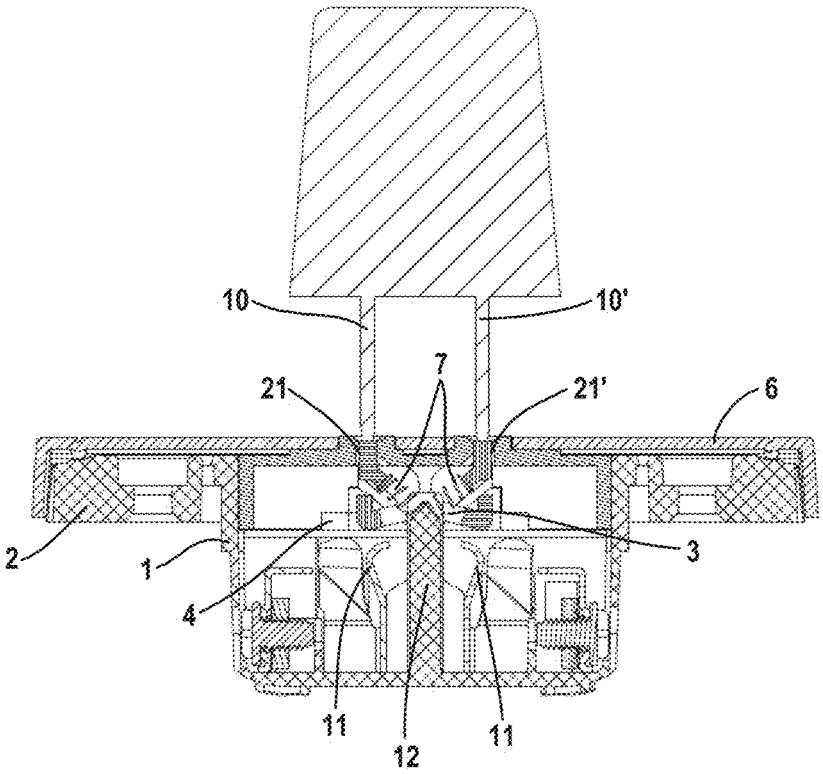
FIG. 1 is sectional view of a socket according to an embodiment of the present invention.

FIG. 1 is sectional view of a socket according to an embodiment of the present invention. In this embodiment, a wall socket is taken as an example to illustrate the socket according to the present utility model. As shown in FIG. 1, the socket comprises a seat body integrally formed by a base 1 and a cover plate 2. Conductive connection pieces 11 are mounted on the base 1, and the cover plate 2 is provided with two insertion holes 21, 21' for insertion of two pins 10 of a plug. The respective conductive connection pieces 11 respectively correspond to locations of the corresponding insertion holes 21, 21' so that when the pins 10, 10' of the plug are inserted into the insertion holes 21, the respective pins of the plug can contact the corresponding conductive connection pieces 11 to achieve electrical connection.

Figure 2:
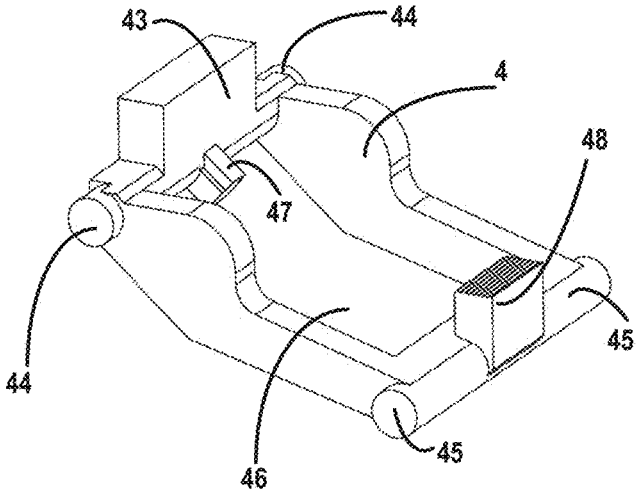
FIG. 2 is a perspective view of a first protective door movable member of a socket according to an embodiment of the present invention.
Figure 3:
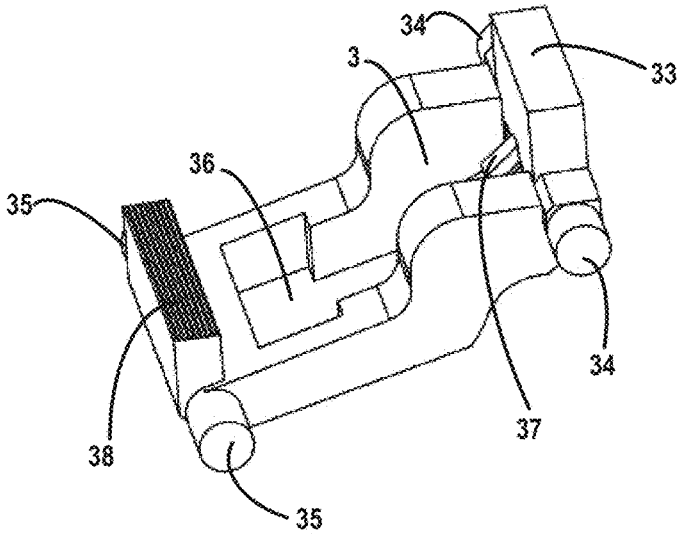
FIG. 3 is a perspective view of a second protective door movable member of a socket according to an embodiment of the present invention.

In the interior of the seat body of the socket, namely, in a space surrounded by the cover plate 2 and the base 1, two separate protective door movable members 3 and 4 are provided respectively for the two insertion holes 21, 21'. As shown in FIGS. 2-3, the protective door movable members 3 and 4 may have similar or completely the same structure. The protective door movable members 3 and 4 have a first end and a second end, wherein protective doors 33, 43 are provided on the first end. The protective doors 33, 43 are shaped to substantially match with the shape of the insertion holes 21, 21' so that they can be easily positioned at the insertion holes 21, 21' to close the insertion holes, but may keep a suitable gap with the insertion holes 21, 21'. On the first end of the protective door movable members 3 and 4 is further provided a first protective door guide structure 34, 44, whereas on the second end of the protective door movable members 3, 4 is further provided a second protective door guide structure 35, 45. The first protective door guide structure 34, 44 is disposed on both sides the first end of the protective door movable members 3 and 4, and the second protective door guide structures 35, 45 is disposed on both sides of the second end of the protective door movable members 3 and 4, to slidably fit with a seat body guide structure provided on the seat body to guide the protective door movable members 3 and 4 to move along a defined trajectory.

Figure 4:
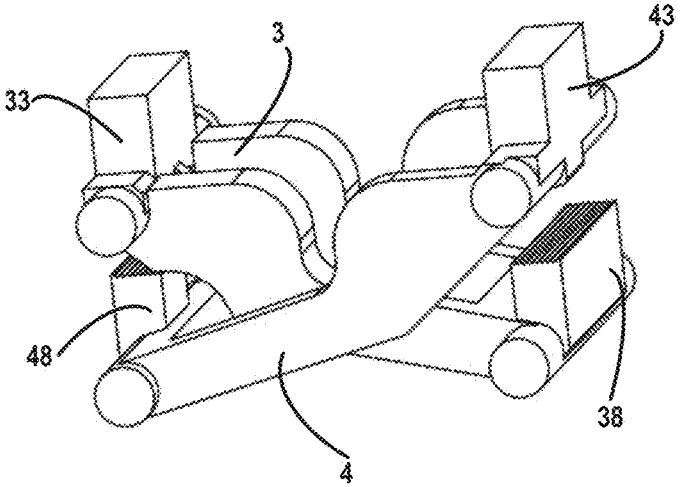
FIG. 4 shows the first protective door movable member and second protective door movable member which are in mated positions.

In the embodiment shown in FIGS. 2-4, the first protective door movable member 3 and second protective door movable member 4 have substantially the same shape, and a slot is provided between the first end and the second end of each of them. The first protective door movable member 3 and second protective door movable member differ from each other in that the slot 46 in the second protective door movable member 4 is wider than the slot 36 in the first protective door movable member 3 so that the first protective door movable member 3 can extend into the slot 46 in the second protective door movable member 4. However, a width of the slot 36 in the first protective door movable member 3 at a location adjacent to the second end at least allows the pins 10 of the plug to extend in. As shown in FIG. 4, the first protective door movable member 3 extends into the slot 46 in the second protective door movable member 4 and is disposed in the seat body symmetrically crossed with the second protective door movable member 4.

In the embodiment shown in FIGS. 2-4, the first protective door guide structures 34, 44 and the second protective door guide structures 35, 45 are guidance protrusions extending from the lateral side of the protective door movable members 3, 4, to engage with guide grooves disposed on the seat body. It is also feasible to provide any other guide structure for the sliding fitting of the first protective door guide structures 34, 44 and the second protective door guide structures 35, 45 and a seat body guide structure. For example, one or all of the first protective door guide structures 34, 44 and the second protective door guide structures 35, 45 may be provided as a guide groove, and the seat body guide structure is configured as a guide rib slidably engaged with the guide groove and defining a movement path for the first protective door guide structures 34, 44 and the second protective door guide structures 35, 45.

When the surface of the protective door 33, 43 closing the insertion holes is placed horizontally facing upward, the first protective door guide structure 34, 44 is located on a level higher than the second protective door guide structure 35, 45, to facilitate guiding the protective door moveable members 3, 4 to move along a defined trajectory to open the shelter of the protective door for the insertion holes, which will be descried in detail later.

Figure 5:
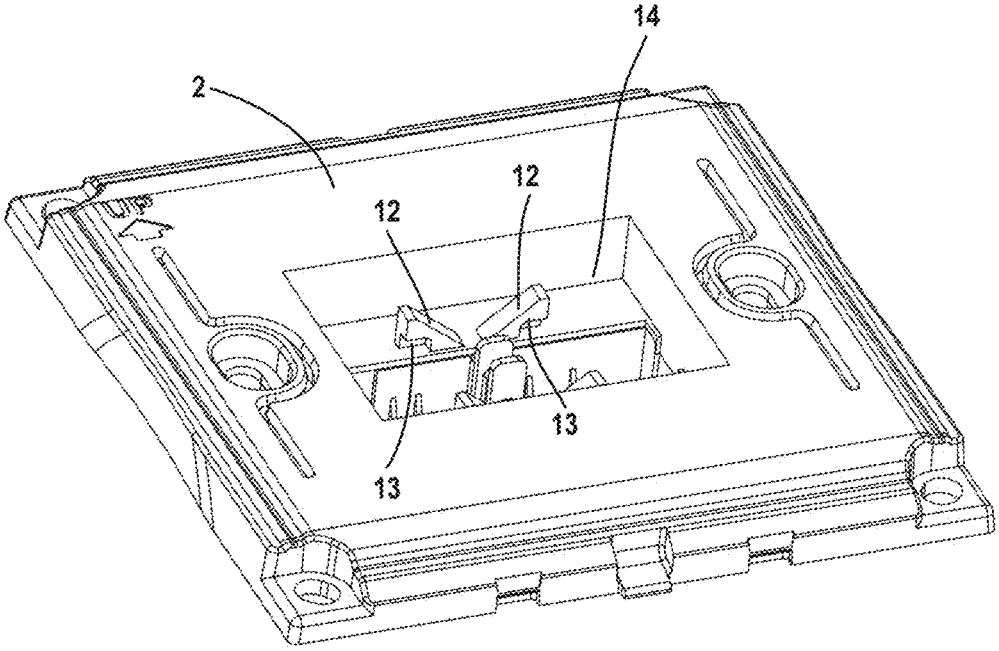
FIG. 5 shows a perspective view of a seat body of a socket according to an embodiment of the present invention.
Figure 6:
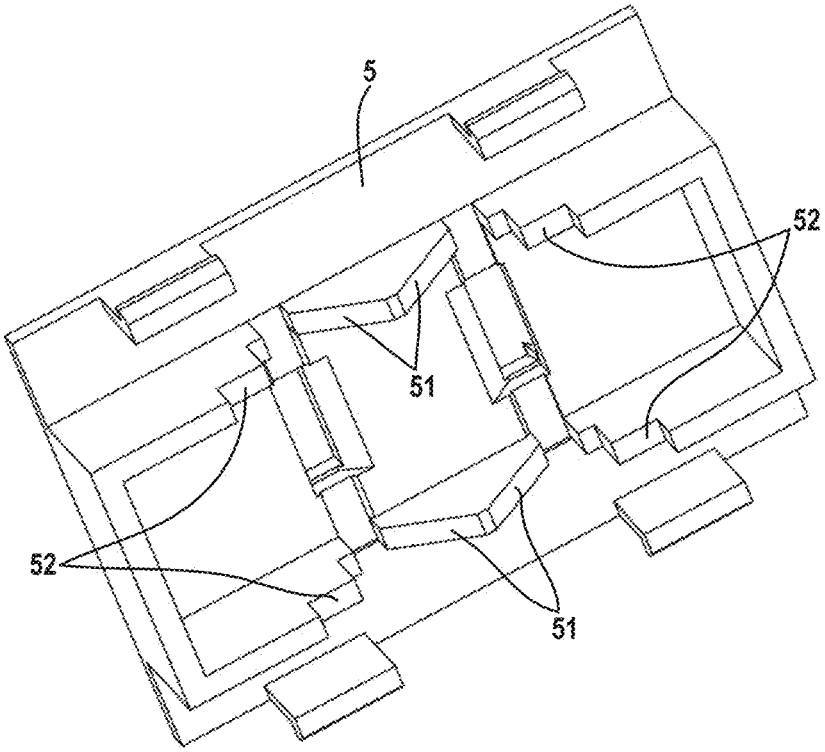
FIG. 6 shows an insert to be inserted into the seat body in FIG. 5.
Figure 7:
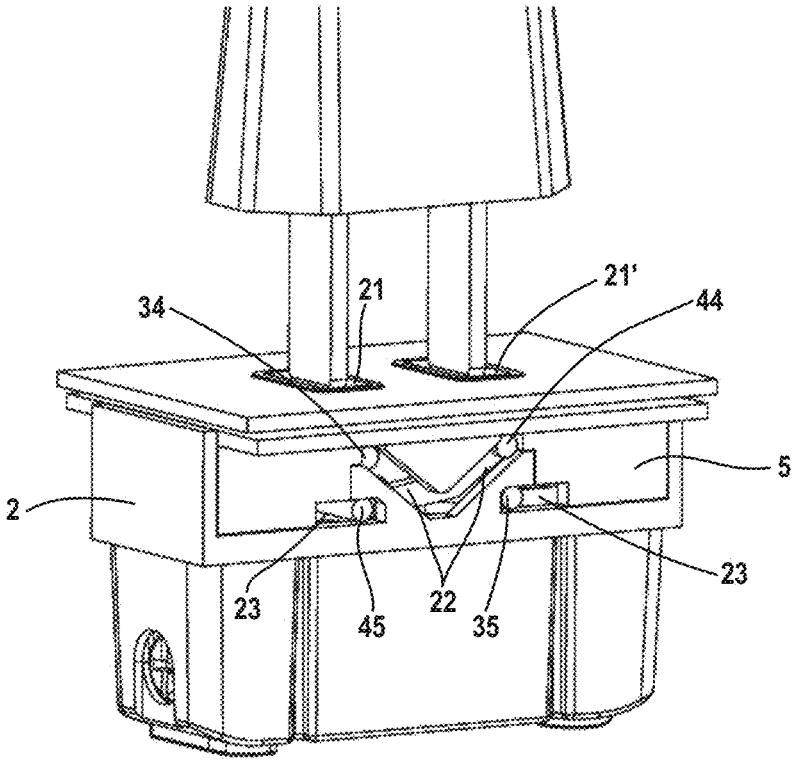
FIG. 7 shows the seat body of FIG. 5 after the insert of FIG. 6 is mounted.

To facilitate the provision of the seat body guide structure in the seat body, as shown in FIG. 5, a mounting slot 14 may be provided on a side in the seat body adjacent to the cover plate 2. The mounting slot 14 is communicated with a space for disposing the conductive connection pieces 11. At the bottom of the mounting slot 14 are provided a pair of inclined guide surfaces 12 and a pair of horizontal guide surfaces 13. An insertion block 5 (see FIG. 6) may be inserted in the mounting slot 14. Guide ramps 51 and stepped faces 52 are disposed on the inner side of the insertion block 5. When the insertion block 5 is inserted in the mounting slot 14, the inclined guide surfaces 12 on the mounting slot 14 will cooperate with the guide ramps 51 on the insertion block 5 to form an inclined guide groove 22 for slidably fitting with the first protective door guide structure 34, 44, whilst the horizontal guide surfaces 13 on the mounting slot 14 will cooperate with the stepped faces 52 on the insertion block 5 to form a horizontal guide groove 23 for slidably fitting with the second protective door guide structure 35, 45, as shown in FIG. 7. In this case, the insertion holes 21, 21' are located on the insertion block 5. The arrangement of the insertion block 5 being separated from the seat body facilitates easily placing the protective door movable members 3, 4 into the mounting slot 14 and then mounting the insertion block 5 to form a complete guide groove. Certainly, it is feasible not to provide a separate insertion block 5 and instead to directly form the guide groove in the seat body.

The inclined guide groove 22 is angled relative to an axial direction of the insertion holes by a non-right angle, and extends obliquely towards a center of the two insertion holes along a movement direction in which the pins of the plug are inserted into the insertion holes, so that when the pins are inserted into the insertion holes, the pins drive the first protective door guide structure 34, 44 at the first end of the protective door structure to slide towards the depth of the insertion holes and towards the center of the two insertion holes. The horizontal guide groove 23 is perpendicular to the axial direction of the insertion hole and extends in a direction parallel to a connection line of centers of the two insertion holes 21, 21', so that when the pins drive the first protective door guide structure 34, 44 at the first end of the protective door structure to slide linearly along the inclined guide groove 22, the horizontal guide groove 23 guides the second protective door guide structure 35, 45 at the second end of the protective door structure to linearly slide along the horizontal guide groove 23. As such, when the pins are inserted into the insertion holes, the two protective door movable structures 3, 4 respectively for the two insertion holes can move towards each other. Furthermore, as the first protective door guide structure 34, 44 and second protective door guide structure 35, 45 are located at different horizontal levels and move along different trajectories, the protective door movable members 3, 4 gradually become "lying down" while moving towards each other, that is, they rotate to a certain extent so that the first ends thereof gradually lower the height. In this way, the two protective door movable members 3, 4 can move simultaneously without interfering with each other, and enable the protective doors 33 and 43 thereon to move towards the insertion direction along the axial direction of the insertion holes and meanwhile move towards the center of the two insertion holes, so as to stagger from the insertion holes 21, 21' so that the pins can further get deeper into the interior of the insertion holes.

Since the cover plate 2 of the seat body or an outer wall of the insertion block 5 has a certain thickness, insertion holes formed thereon have a certain depth (e.g., several millimeters). If a face cover 6 for purpose of a decoration effect is provided on the seat body and face cover holes in alignment with the insertion holes on the seat body are also provided on the face cover 6 as shown in FIG. 1, a total depth of the insertion hole and the face cover hole will be larger. It is desirable to extend the protective doors 33, 43 of the protective door movable members 3, 4 into the interior of the insertion holes, even allow a top (namely a face towards outside of the insertion hole) of the protective doors 33, 43 to be flush with an outermost edge of the face cover hole (e.g., an outer surface of the face cover 6) to obtain a substantially flat socket outer surface. In this case, when the plug is inserted into the insertion holes, to enable the protective doors 33, 43 to first retreat from the narrow insertion holes smoothly, it is necessary to enable the protective doors 33, 43 to move in the insertion holes substantially only in the axial direction of the insertion holes and substantially not move or move at a very small extent in other directions (particularly a direction perpendicular to the axial direction of the insertion holes). To this end, the seat body guide structure may provide guidance only in the axial direction of the insertion holes for the first protective door guide structure 34, 44 at the first end of the protective door movable member 3, 4 when the plug is just begin to be inserted into the insertion holes. For example, as shown in FIG. 7, an upper end of the inclined guide groove 22 closer to outside of the insertion holes is connected to an axial guide groove which is substantially along the axial direction of the insertion holes and is communicated with the inclined guide groove 22. As such, when the plug is just begin to be inserted into the insertion holes, the first protective door guide structure 33, 44 at the first end of the protective door movable member 3, 4 can only move substantially in the axial direction of the insertion holes to smoothly retreat out of the narrow insertion holes.

A spring mounting posts 37, 47 is further provided at the first end of the protective door movable member 3, 4 and inside the slot 36, 46, and a spring supporting post 12 is disposed in the seat body. Between the spring mounting post 37, 47 of the respective protective door movable members 3, 4 and the spring supporting post 12 are respectively provide a return spring 7, so that after the pins of the plug retreat out of the insertion holes 21, 21', a return force of the return spring 7 forces the protective door movable member 3, 4 to move reversely along a defined trajectory to close the corresponding insertion holes 21, 21' again. Favorably, the spring mounting post 37, 47 is disposed substantially along an extension direction of the inclined guide groove 22, and the spring supporting post 12 is also provided with an inclined end face substantially perpendicular to the extension direction of the inclined guide groove 22, so that the return spring 7 is fixed to extend substantially along the extension direction of the inclined guide groove 22. The return spring 7 arranged in this way facilitates providing a return force for the protective door movable member 3, 4 along the extension direction of the inclined guide groove 22, so that the protective door movable members 3, 4 smoothly move along a trajectory defined by the inclined guide groove 22 to a location for closing the insertion holes.

Figure 8A:
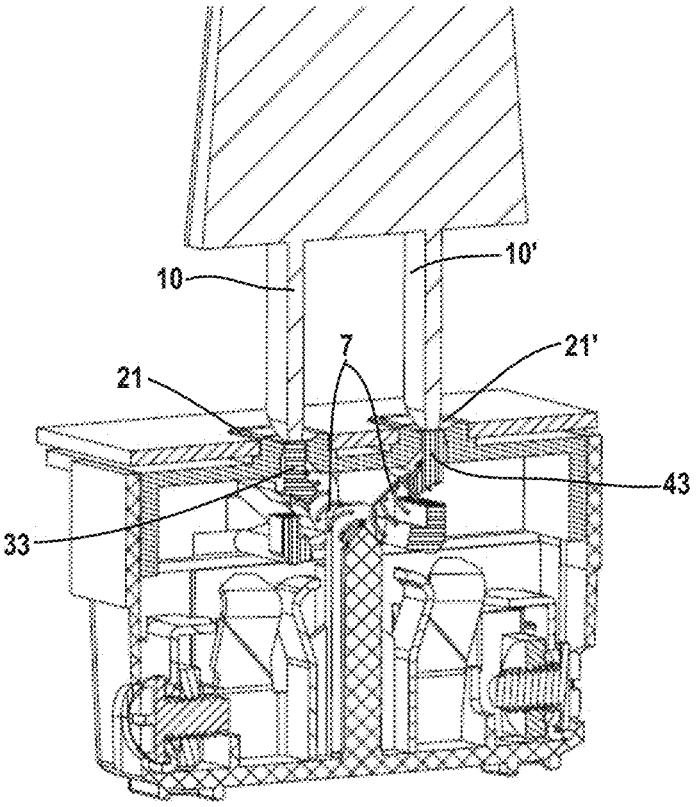
FIG. 8*a* shows a sectional view of a socket according to the embodiment of the present invention when the plug is not yet inserted into the socket.
Figure 8B:
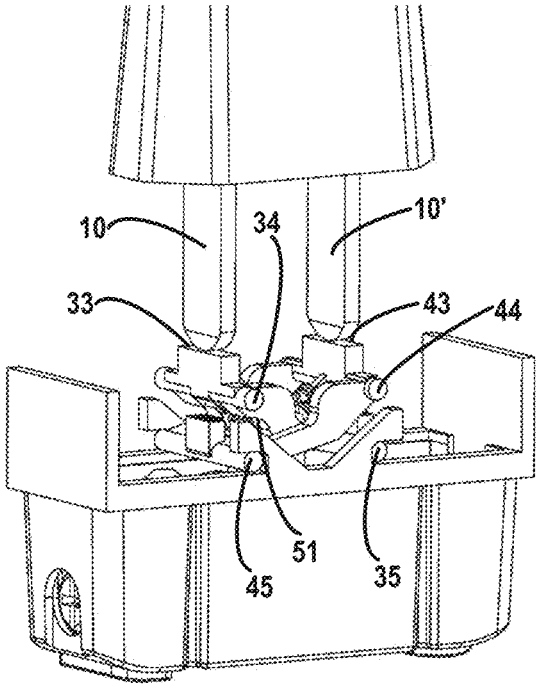
FIG. 8*b* shows a perspective view of a socket according to the embodiment of the present invention when the plug is not yet inserted into the socket, wherein the insert and the top of the seat body are removed.

As shown in FIGS. 8*a*-8*b*, when the pins 10, 10' of the plug have not yet been inserted into the insertion holes or just begin to contact the protective door surface in the insertion holes, the protective door movable member 3, 4 is only subjected to action of the return force of the return spring 7 and guided by the seat body guide structure to enable the protective door 33, 43 at the first end thereof to be located at a position closest to the outside of the insertion hole 21, 21', for example, a position which is in the insertion holes and substantially flush with an outer surface of the panel 2 or face cover 6, to close the insertion holes. At this time, the first protective door guide structure 34, 44 at the first end of the protective door movable member 3, 4 is at a position at its uppermost end in the axial direction of the insertion holes (the direction in which the pins of the plug are inserted into the insertion holes is defined as an up-down direction), and is spaced apart a certain gap from the guide ramp 51 on the insertion block 5, while the second protective door guide structure 35, 45 at the second end of the protective door movable member 3, 4 is located at a position closest to the middle of the two insertion holes 21, 21'.

Figure 9A:
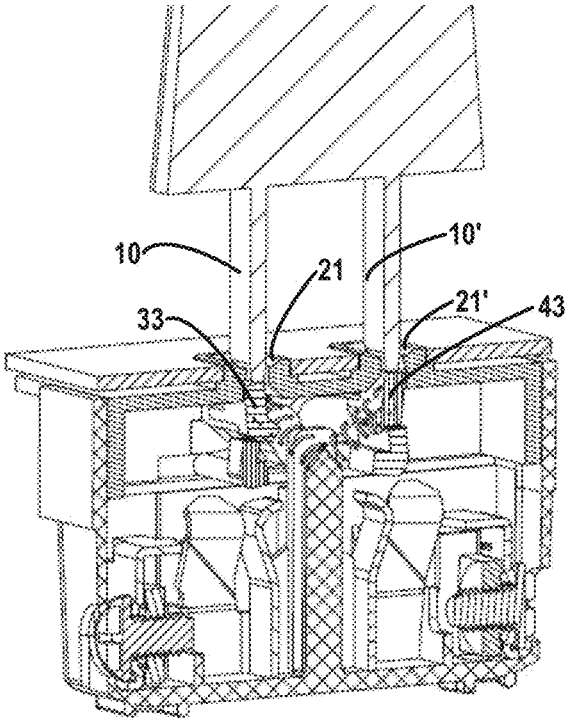
FIG. 9*a* shows a sectional view of a socket according to the embodiment of the present invention when the plug has just been inserted into the socket.
Figure 9B:
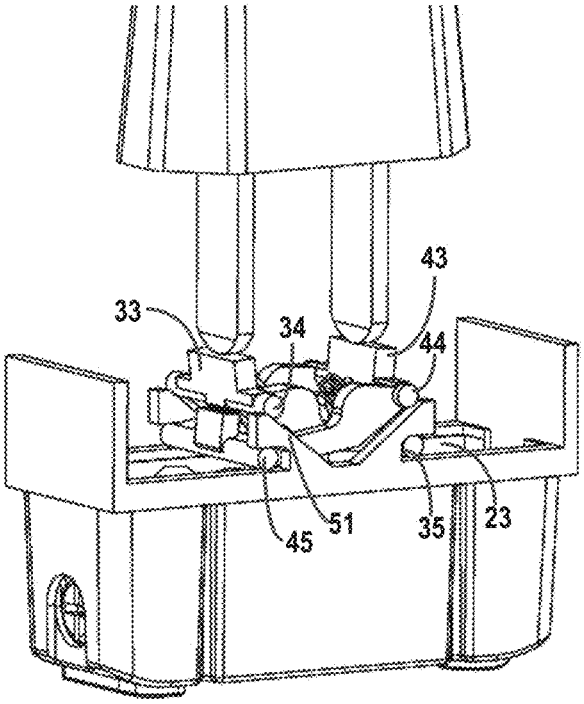
FIG. 9*b* shows a perspective view of a socket according to the embodiment of the present invention when the plug has just been inserted into the socket, wherein the insert and the top of the seat body are removed.

As shown in FIGS. 9*a*-9*b*, when the pins 10, 10' of the plug are slightly inserted into the insertion holes 21, 21', since the protective doors 33, 43 are constrained in the narrow insertion holes formed on the panel 2 or face cover 6, the protective doors 33, 43 and the first ends of the protective door movable members 3, 4 can only be pushed by the pins 10, 10' to move downwardly only in the axial direction of the insertion holes against the force of the return spring 7, until the first protective door guide structures 34, 44 begin to contact the guide ramp 51 on the insertion block 5, whereby the protective doors 33, 43 substantially retreat out of the narrow insertion holes 21, 21' and enter a more spacious internal space of the seat body. During movement, the second protective door guide structures 35, 45 substantially keep still or slightly move away from the center of the two insertion holes. Hence, the whole movement of the protective doors 33, 43 is more like a pivotal movement of the protective doors 33, 43 about the second protective door guide structures 35, 45, so that weak pivotal tilt of the protective doors 33, 43 relative to the axial direction of the insertion holes may occur during the process of the protective doors 33, 43 retreating out of the insertion holes. Since the gap between the first protective door guide structure 34, 44 and the guide ramp 51 is very small, it only allows the protective door to move to right retreat out of the depth (several millimeters) of the insertion holes, so the protective door generates a very small amount of pivotal tilt in the small stroke. The fitting gap between the protective doors 33, 43 and the insertion holes 21, 21' is sufficient to allow the protective doors to generate the small tilt in the insertion holes without getting stuck in the insertion holes.

Figure 10A:
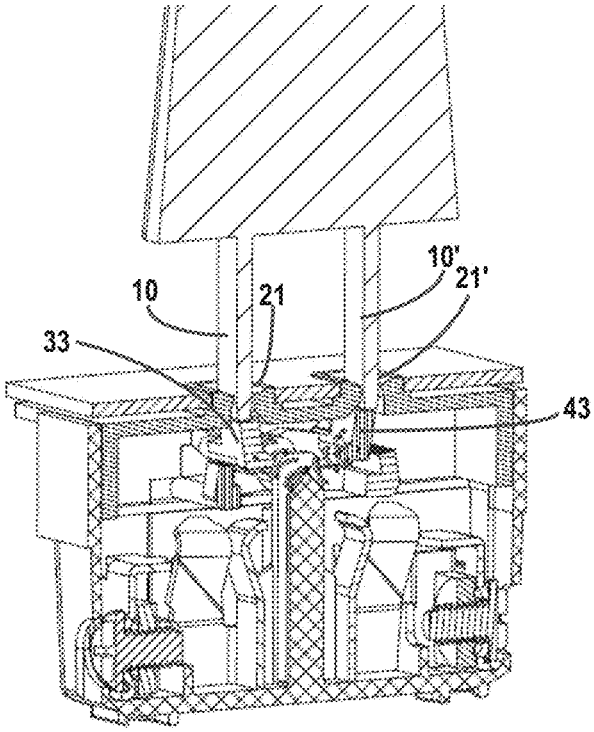
FIG. 10*a* shows a sectional view of a socket according to the embodiment of the present invention when the plug is further inserted into the socket.
Figure 10B:
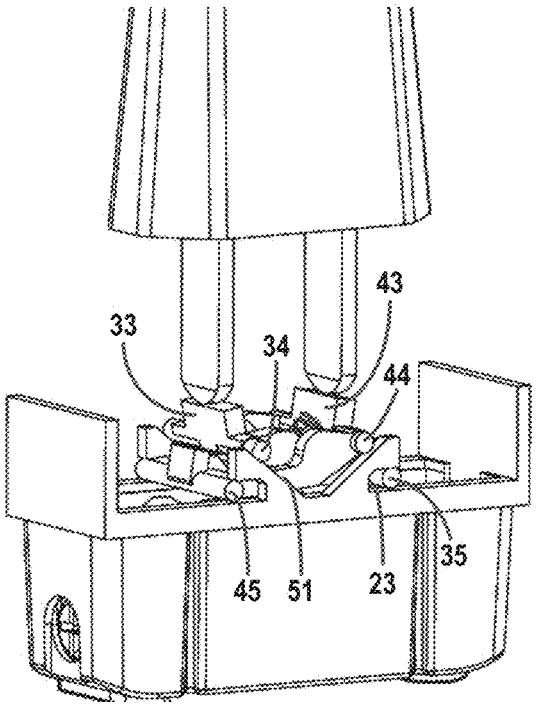
FIG. 10*b* shows a perspective view of a socket according to the embodiment of the present invention when the plug is further inserted into the socket, wherein the insert and the top of the seat body are removed.

As shown in FIGS. 10*a*-10*b*, when the pins 10, 10' of the plug are further inserted into the insertion holes 21, 21', the first protective door guide structure 34, 44 begins to move downward and towards the center of the two insertion holes along an inclined trajectory defined by the guide ramp 51, and will not be constrained by the insertion holes. At this time, since the first protective door guide structure 33, 44 and the first end of the protective door movable member 3, 4 has a remarkable movement travel, the second protective door guide structure 35, 45 at the second end of the protective door movable member 3, 4 will be therefore pushed to move along the horizontal guide groove 23 towards a direction away from the center of the two insertion holes. At this time, since the first protective door guide structure 34, 44 and the second protective door guide structure 35, 45 are guided along different seat body guide structures, the movement trajectories of the two are different, wherein the first protective door guide structure 34, 44 has a prominent movement component in the axial direction of the insertion holes and a movement component perpendicular to the axial direction of the insertion holes, whereas the second protective door guide structure 35, 45 has a movement component perpendicular to the axial direction of the insertion holes which is greater than that of the first protective door guide structure 34, 44 and, and almost has no movement component in the axial direction of the insertion holes. Due to different movement trajectories of the two ends of the protective door movable member 3, 4, the protective door movable member 3, 4 actually makes a composite movement including translation and rotation, and the protective door movable member 3, 4 is enable to "lie down" gradually so that the protective doors 33, 43 thereby generate a movement component towards the center of the two insertion holes, namely, the two protective doors 33, 43 move towards each other to stagger the two insertion holes 21, 21'.

Figure 11A:
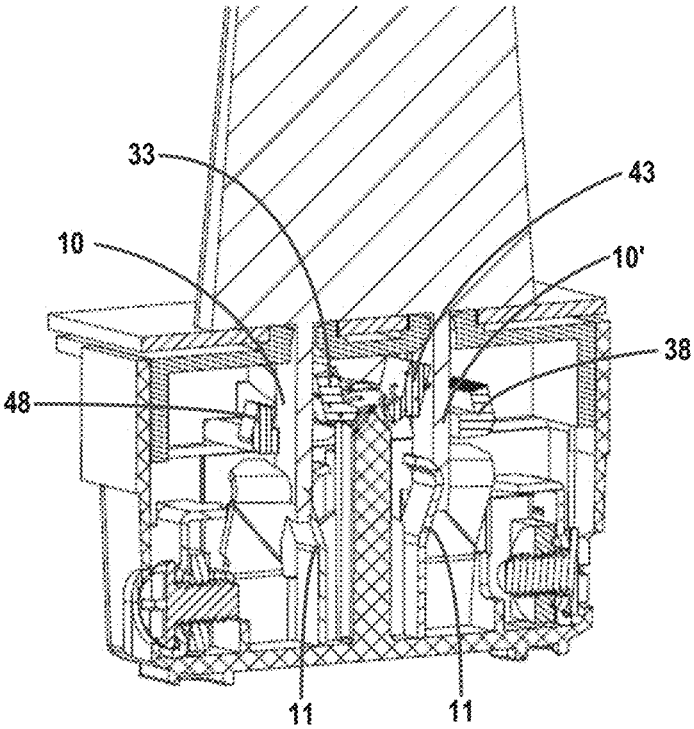
FIG. 11*a* shows a sectional view of a socket according to the embodiment of the present invention when the plug has completely been inserted into the socket.
Figure 11B:
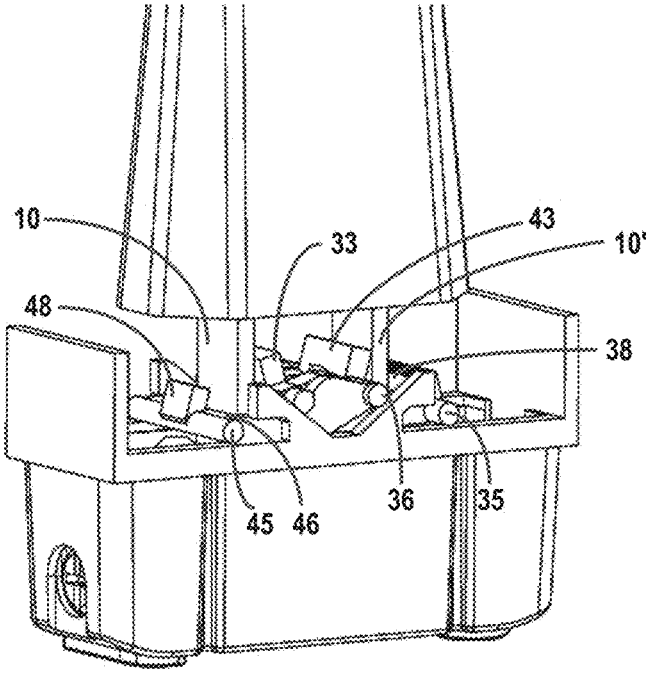
FIG. 11*b* shows a perspective view of a socket according to the embodiment of the present invention when the plug has completely been inserted into the socket, wherein the insert and the top of the seat body are removed.

As shown in FIGS. 11*a*-11*b*, after the pins 10, 10' of the plug are further inserted into the insertion holes 21, 21' to make the protective doors 33, 43 completely staggered from two insertion holes 21, 21', the two protective doors 33, 43 are closer to each other, and a portion of the slot 46 in the second protective door movable member 4 is exposed between the protective door 33 of the first protective door movable member 3 and the second protective door guide structure 45 at the second end of the second protective door movable member 4; likewise, a portion of the slot 36 in the first protective door movable member 3 is exposed between the protective door 43 of the second protective door movable member 4 and the second protective door guide structure 35 at the second end of the first protective door movable member 3. At this time, the pins 10, 10' of the plug can respectively run through the two slots 46, 36 and pass by the protective door movable members 3, 4 from the external of the first end of the protective door movable members 3, 4 corresponding to the insertion holes into which the pins are inserted, until the pins are completely inserted into the interior of the seat body and respectively electrically contact the conductive connection pieces 11.

In the process of drawing the pins of the plug out of the insertion holes, the return spring 7 will, along an inclination direction substantially the same as the guide ramp 51, push the protective door movable members 3, 4 to move along the same trajectory as the movement trajectory when the pins are previously inserted but in a direction opposite to it, so that the protective doors 33, 43 return to the position for closing the insertion holes 21, 21'.

As the protective door movable member 3, 4 in the socket in the present invention has a guide structure respectively at the first end and second end, and the first protective door guide structure and second protective door guide structure are enabled to have different movement trajectories, the protective door movable member 3, 4 can make a composite movement synthesized from translation and rotation when being driven by the pins to move. As such, the two protective door movable members 3, 4 can smoothly move without mutual interference to open the insertion holes, and meanwhile a space occupied by the protective door movable members 3, 4 in the axial direction of the insertion holes on the whole almost does not move, because the second protective door guide structure substantially moves perpendicular to the axial direction of the insertion holes, and a final position to which the first protective door guide structure moves in the axial direction of the insertion holes does not exceed the position of the second protective door guide structure in the axial direction of the insertion holes. Hence, the two protective door movable members 3, 4 achieve staggering from the insertion holes in a "lie-down" manner not in a manner of moving downward in the axial direction of the insertion holes on the whole, so that the protective door movable members do not occupy more limited axial space in the seat body of the socket during movement such that the socket may be designed thinner. In addition, this also make the movement of the protective door movable members 3, 4 not hinder smooth contact between the pins of the socket and the conductive connection pieces 11 in the seat body.

To achieve the above-mentioned "lie-down" composite movement of the protective door movable members 3, 4, the first protective door guide structure 34, 44 does not certainly move along an inclined linear path defined by the guide ramp 51 as stated in the above embodiment, but may be guided to move along various trajectories, e.g., move along an arcuate trajectory or other curved trajectories, so long as it is ensured that the movement of the first protective door guide structure has a downward component in the axial direction of the insertion holes as well as a component which is towards the center of the two insertion holes and perpendicular to the axial direction of the insertion holes. The second protective door guide structure 35, 45 does not certainly move along a linear path strictly perpendicular to the axial direction of the insertion holes as stated in the above embodiment, but may have a movement component slightly along the axial direction of the insertion holes. The "lie-down" composite movement of the protective door movable member 3, 4 can be implemented to achieve the staggering of the protective door movable member 3, 4 from the insertion holes in a case that it almost does not wholly move in the axial direction of the insertion holes or less wholly moves in the axial direction of the insertion holes, so long as the movement component of the first protective door guide structure 34, 44 in the axial direction of the insertion holes is ensured greater than the movement component of the second protective door guide structure 35, 45 in the axial direction of the insertion holes, and the movement component of the first protective door guide structure 34, 44 perpendicular to the axial direction of the insertion holes is ensured smaller than the movement component of the second protective door guide structure 35, 45 perpendicular to the axial direction of the insertion holes. Based on this principle, the seat body guide structures respectively used for the first protective door guide structure 34, 44 and the second protective door guide structure 35, 45 may be designed coordinately to enable the movement trajectories of the two to meet the above requirement.

Figure 12:
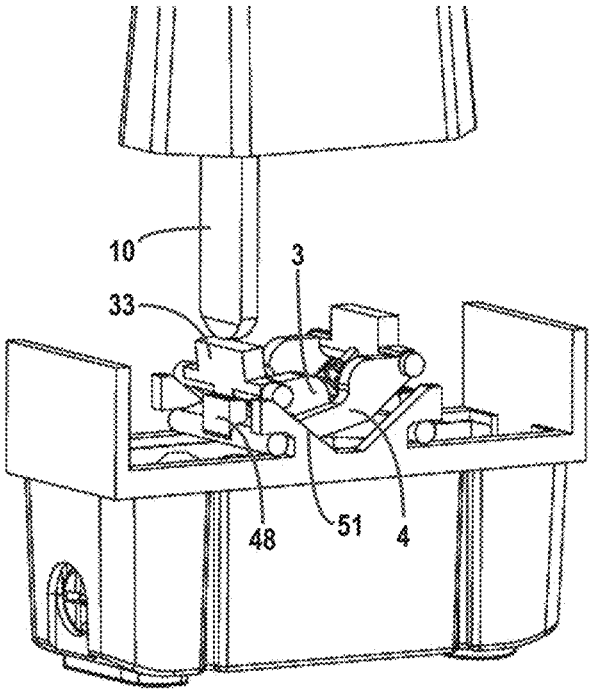
FIG. 12 shows a state in which a protective door movable member is locked when a single pin of the plug acts upon one protective door movable member of the socket according to the embodiment of the present invention.

As shown in FIGS. 2-4, in an embodiment, the second end of the protective door movable member 3, 4 is respectively provided with a locking protrusion 38, 48. The locking protrusion 38, 48 protrudes towards the same side as the protective door 33, 43. As such, when the two protective door movable members 3, 4 are arranged crossed, the locking protrusion 38, 48 of each protective door movable member 3, 4 is located below the protective door 43, 33 at the first end of the other protective door movable member 4, 3. As shown in FIG. 12, when only one pin 10 of the plug is inserted into one 21 of the two insertion holes, the protective door movable member 4 corresponding to the insertion hole into which no pin is inserted does not make any movement due to absence of action of the pin, so the locking protrusion 48 at the second end of the protective door movable member 4 is still located below the protection door 33 of the protective door movable member 3. At this time, after the protective door 33 of the proactive door movable member 3 is guided by the guide ramp 51 to move and displace in the axial direction of the insertion holes and contact the locking protrusion 48 located therebelow, due to the blocking of the locking protrusion 48, the protective door 33 cannot continue to further move along the guide ramp 51 to a degree in which the insertion hole 21 is opened. Therefore, the single pin 10 cannot be further inserted to a deeper location in the insertion hole 21 to contact the conductive connection piece 11 therein. In this way, dangerous operation of inserting a single pin of the plug into the insertion hole of the socket is prevented.

However, the locking protrusions 38, 48 do not hinder a normal operation of both pins of the plug of simultaneously inserting into the two insertion holes. As shown in FIGS. 11*a*-11*b*, when both pins 10, 10' of the plug are respectively simultaneously inserted into the two insertion holes 21, 21', the two protective door movable members 3, 4 are both driven to move so that the second ends of the two protective door movable members 3, 4 and the locking protrusions 38, 49 on the second ends all move towards a position away from the center of the two insertion holes, whereby the locking protrusion 38, 48 on each protective door movable member 3, 4 leaves from below the protective door 43, 33 at the first end of the other protective door movable member 4, 3 and no longer blocks further downward movement of the protective door 43, 33 in the axial direction of the insertion holes. As such, the protective door 43, 33 can continue to move along the guide ramp of the seat body guide structure to expose the slot 46, 36 of each protective door movable member 3, 4 between the protective door 43, 33 and the locking protrusion 38, 48 to allow the two pins 10, 10' to run therethrough respectively and contact the conductive connection pieces 11.

In an alternative embodiment, the protective door movable members 3, 4 may be disposed not crossed. Instead, one of the protective door movable members 3, 4 is disposed separate from the other, i.e., the first protective door movable member 3 and second protective door movable member 4 are respectively completely located on the two sides of the center of the two insertion holes 21, 21' without any overlap, and the first protective door guide structures 34, 44 are closer to the center of the two insertion hole 21, 21' than the second protective door guide structures 35, 45. In this case, guide paths for the first protective door guide structure 34, 44 and the second protective door guide structure 35, 45 in the seat body guide structure should be, as compared with the guide path in the case that the protective door movable members are disposed crossed as stated above, opposite in a direction perpendicular to the axial direction of the insertion hole while identical in a direction along the axial direction of the insertion hole. For example, in the case of movement along the inclined linear path defined by the guide ramp 51, the guide ramp 51 extends obliquely from a horizontal level adjacent to the insertion hole and a position in the axial direction of the insertion hole towards deep into the insertion hole and towards a direction away from the center of the two insertion holes; guide paths for the second protective door guide structure 35, 45 in the seat body guide structure are located at a position further away from the center of the two insertion holes than the corresponding first protective door guide structure 34, 44. As such, when the pins of the plug extend into the insertion holes 21, 21', the first ends of the two protective door movable members 3, 4 are driven away from each other so that the two protective door movable members 3, 4 also make the "lie-down" movement compositely formed by translation and rotation, whereby each pin of the plug can pass by the protective door movable member 3, 4 at the external of the first end of the protective door movable member 3, 4 corresponding to the insertion hole into which the pin is inserted and is inserted into the seat body of the socket body to contact the conductive connection piece. In this case, the two protective door movable members 3, 4 would not overlap, and it is not necessary to provide slots 36, 46 thereon to allow the pin and the other protective door movable member to run therethrough.

In an embodiment, a side of the protective door 33, 43 facing towards outside of the insertion hole is substantially planar. As such, when the protective door extends into the insertion hole, the insertion hole is substantially flush with the cover plate 2 of the socket as viewed from the external of the socket. In the case that a decorative face cover 6 is further disposed outside the seat body of the socket, in a state that the protective door movable member 3, 4 closes the insertion holes, the plane of the protective door 33, 43 of the protective door movable member 3, 4 facing towards outside of the insertion holes is substantially flush with the outer surface of the face cover 6. As such, the protective door at the insertion hole is almost integrated with the face cover and the insertion hole cannot be easily observed, as viewed from the external of the socket. In this way, a more pleasant and clean socket outer surface is obtained.

The protective door substantially parallel to the surface of the socket cover plate or face cover also avoids accumulation of dirt such as dusts in the insertion hole or on the protective doors, thereby further facilitating achievement of a neat and tidy appearance of the socket. Furthermore, since the protective door in each insertion hole is formed by a single piece of protective door part, formation of engagement lines between multiple parts of the protective door is also avoided in the single insertion hole, so that the socket is made more neat and tidy.

Although the socket according to the present invention is introduced by taking the wall-mounted socket as an example, it should be appreciated that the socket of the present invention may take other forms, e.g., commonly-used terminal board (namely, a power strip), or even may be various interface insertion slots on electrical devices. Furthermore, the socket in the present invention may be either a power supply socket or various signal line sockets, e.g., sockets for Internet wires, cabled television wires, or telephone wires, or a combination of a power supply socket and signal line socket.

The description of the present invention has already been presented for purses of illustration and depiction, but this does not intend to exhaust or limit the forms of the present invention. Those skilled in the art may envisage many modifications or variations.

Hence, embodiments are selected and depicted to better illustrate principles and practical use of the present invention and to enable those skilled in the art to understand the following content, namely, all modifications and substitutions without departing from the spirit of the present invention all fall within the protection scope of the present invention as defined by the appended claims.

What is claimed is:

1. A socket, comprising:

a seat body including two insertion holes allowing two pins of a plug to insert respectively; wherein, an individual protective door movable member is disposed for each of the insertion holes in the seat body, the protective door movable members are configured in a way that when no pin of a plug is inserted into the insertion holes, the protective door movable members close corresponding insertion holes, and when the pins of a plug are inserted into the insertion holes, the protective door movable members are driven to move along a defined trajectory to open the corresponding insertion holes to allow the pins of the plug to extend into the insertion holes, and wherein movement of the protective door movable members along the defined trajectory makes the movement trajectory of at least a portion of the protective door movable members different from the movement trajectory of another portion of the protective door movable members; and wherein the protective door moveable members have a first end and a second end, the first end is provided with a protective door cooperating with the insertion hole and a first protective door guide structure, the second end is provided with a second protective door guide structure, the first protective door guide structure and the second protective door guide structure are guided by a seat body guide structure on the seat body such that a movement component of the first protective door guide structure in an axial direction of the insertion hole is greater than a movement component of the second protective door guide structure in the axial direction of the insertion hole, and a movement component of the first protective door guide structure in a direction perpendicular to the axial direction of the insertion hole is smaller than a movement component of the second protective door guide structure in a direction perpendicular to the axial direction of the insertion hole.

2. The socket according to claim 1, wherein the first protective door guide structure and the second protective door guide structure are guided by the seat body guide structure on the seat body such that the first protective door guide structure moves in a linear manner or a curve manner in a direction inclined relative to the axial direction of the insertion hole, and the second protective door guide structure moves in a direction perpendicular to the axial direction of the insertion hole.

3. The socket according to claim 1, wherein a slot is provided between the first end and second end of the protective door movable member, and one of the protective door movable members runs through the slot in the other of the protective door movable members and is disposed crossed with the other of the protective door movable members so that when the pins of the plug extend into the insertion holes, the first ends of the two protective door movable members are driven towards each other, so that each pin of the plug runs through the slot in the other protective door movable member between the protective door of the protective door movable member corresponding to the insertion hole into which the pin is inserted, and the second end of the other protective door movable member.

4. The socket according to claim 1, wherein one of the protective door movable members is disposed separate from the other so that when the pins of the plug are inserted into the insertion holes, the first ends of the two protective door movable members are driven away from each other so that each pin of the plug can pass by the protective door movable member outside the first end of the protective door movable member corresponding to the insertion hole into which the pin is inserted.

5. The socket according to claim 1, wherein the first protective door guide structure and the second protective door guide member are guide protrusions while the seat body guide structure is a guide groove slidably fitting with the guide protrusions, or the seat body guide structure is a guide protrusion while the first protective door guide structure and the second protective door guide member are guide grooves slidably fitting with the guide protrusion.

6. The socket according to claim 5, wherein the seat body guide structure is further configured to guide the first protective door guide structure to move only in the axial direction of the insertion hole when the pins of the plug are just begin to extend into the insertion holes.

7. The socket according to claim 5, wherein a mounting slot is provided on the seat body, a guide surface is disposed in the mounting slot, an insertion block is inserted in the mounting slot, the insertion holes are located on the insertion block, a guide surface is disposed on the insertion block so that the guide surface on the insertion block cooperates with the guide surface in the mounting slot to form the guide groove slidably fitting with the first protective door guide structure and second protective door guide structure.

8. The socket according to claim 5, wherein a return spring is connected between the protective door movable member and the seat body to urge the protective door movable member to move in a reverse direction along the defined trajectory to close the corresponding insertion hole again after the pins of the plug retreat out of the insertion holes.

9. The socket according to claim 5, wherein locking protrusions are provided on the second ends of the protective door movable members, wherein when only one of the two insertion holes is inserted with a pin of the plug, the locking protrusion on the protective door movable member corresponding to the insertion hole into which the pin is not yet inserted blocks movement of the protective door movable member corresponding to the insertion hole into which the pin is inserted, to block further insertion of the pin which is already inserted into the insertion hole.

10. The socket according to claim 1, wherein a side of the protective door facing towards outside of the insertion hole is a plane.

11. The socket according to claim 10, wherein a face cover is further provided on an outer surface of the seat body, face cover holes in alignment with the insertion holes are provided on the face cover at positions corresponding to the insertion holes, and in a state that the protective door movable members close the insertion holes, the plane of the protective door of the protective door movable member facing towards outside of the insertion holes is substantially flush with the outer surface of the face cover.

* * * * *